US008998515B2

(12) United States Patent
deJong et al.

(10) Patent No.: US 8,998,515 B2
(45) Date of Patent: Apr. 7, 2015

(54) SYSTEM AND METHOD FOR MEDIA CURLER CHARACTERIZATION

(75) Inventors: Joannes N. M. deJong, Hopewell Junction, NY (US); Martin Krucinski, Webster, NY (US); Faming Li, Penfield, NY (US); Marina Tharayil, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 415 days.

(21) Appl. No.: 13/223,087

(22) Filed: Aug. 31, 2011

(65) Prior Publication Data

US 2013/0051890 A1 Feb. 28, 2013

(51) Int. Cl.

| | |
|---|---|
| ***B41J 13/00*** | (2006.01) |
| ***B41J 13/10*** | (2006.01) |
| ***B41J 11/00*** | (2006.01) |

(52) U.S. Cl.

CPC ..... *B41J 13/10* (2013.01); *B41J 11/0005* (2013.01)

(58) Field of Classification Search

USPC ..... 399/401, 406, 388; 271/188

See application file for complete search history.

(56) References Cited

U.S. PATENT DOCUMENTS

| | | | | |
|---|---|---|---|---|
| 5,737,681 | A * | 4/1998 | Hyakutake et al. | 399/388 |
| 6,259,888 | B1 * | 7/2001 | Kazama et al. | 399/406 |
| 2008/0279571 | A1 * | 11/2008 | Noda et al. | 399/16 |
| 2009/0154976 | A1 * | 6/2009 | Castillo et al. | 399/406 |

* cited by examiner

*Primary Examiner* — Matthew G Marini

(74) *Attorney, Agent, or Firm* — Hoffmann & Baron, LLP

(57) ABSTRACT

Embodiments described herein are directed to characterizing a media curler for a printing. Test curls can be imposed on media having input curls with known input values using a media curler to be characterized. The media curler can impose the test curls based on curler settings of the media curler. Resulting output values from an interaction between the test curls and the input curls can be measured and the curler settings can be characterized based on the known input values and the resulting output values so that the media curler can be configured to respond to incoming media having a known input curl by applying curler setting to achieve a desired output curl.

19 Claims, 4 Drawing Sheets

SYSTEM AND METHOD FOR MEDIA CURLER CHARACTERIZATION

BACKGROUND

1. Technical Field

The presently disclosed embodiments are directed to characterizing a media curler for use in a printing system.

2. Brief Discussion of Related Art

Media curlers are frequently used to impose a curl onto media. In cases where the media is fed onto a vacuum or electrostatic hold-down transport, a curl towards the media transport typically improves hold-down performance. In other applications, it may be desirable to remove a curl from media before feeding the media to downstream devices and/or before the media appears in an output device of a printing system. For example, in a direct marking printing system a distance between print nozzle ejection surface of a print head and the media in the printing region can be important for proper operation of the printing system. To ensure sufficient media flatness, a curl can be imposed on the media before the media enters the printing region using a media curler.

Media curlers can have an actuator to control an amount of curl applied by the media curler. In this manner, different actuator settings can impose different amounts of curl onto the media. Besides the actuator setting, the amount of imposed curl can be a function of many parameters, such as weight, grain direction, thickness, elastic modulus, moisture content, and the like of the media. These parameters (e.g., actuator and/or media parameters) can cause curls imposed by a media curler to be unpredictable, especially if different types of media are used.

SUMMARY

According to aspects illustrated herein, there is provided a media curler characterization system including a media curler to be characterized, a measurement module, and a processing device. The media curler curls media to a pre-curl in a first pass and curls the media with the pre-curl to form an output curl in a second pass based on a selected curler setting. The measurement module measures an input value of the pre-curl and measures an output value of the output curl. The processing device forms an association of the curler setting with the output value for the input value and configures the media curler responsive to the association.

According to other aspects illustrated herein, there is provided a media curler characterization system including a first media curler, a first measurement module, a second media curler, and a second measurement module. The first media curler curls media to an input curl. The first measurement module is positioned downstream of the first media curler and measures an input value of the input curl. The second media curler is positioned downstream of the first measurement module. The second media curler is under characterization and curls the input curled media to form an output curl based on a selected curler setting. The second measurement module is positioned downstream of the second media curler and measures an output value of the output curl.

According to other aspects illustrated herein, there is provided a method of characterizing a media curler for a printing system. The method includes applying curls to media having pre-curls with known input values to form an output curl using a media curler to be characterized. The media curler applies the curls based on curler settings of the media curler. The method further includes measuring resulting output values of the output curls and associating the resulting output values with the curler settings and input values corresponding to the resulting output values.

DETAILED DESCRIPTION

Figure 1:
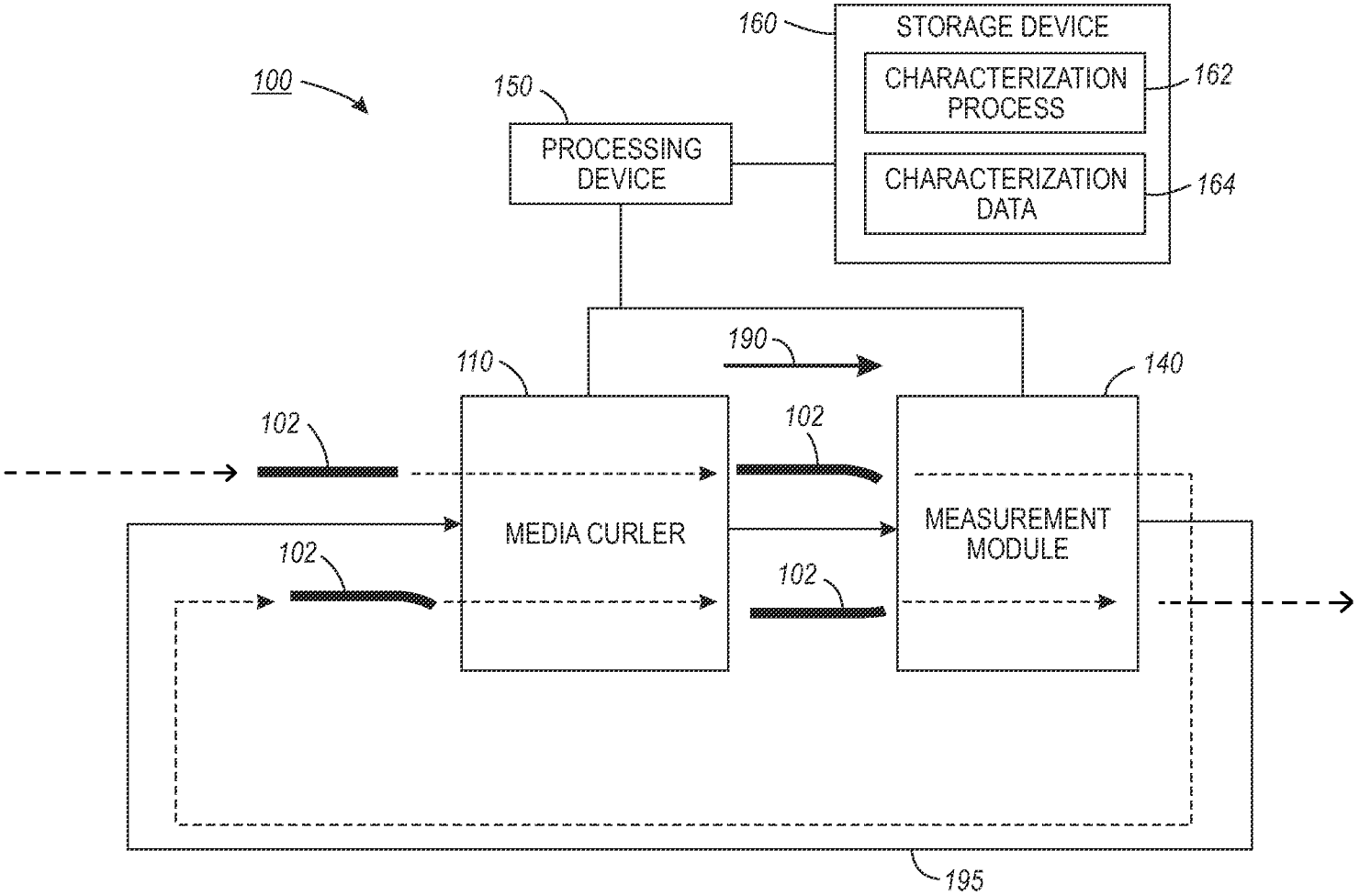
FIG. 1 shows an exemplary media curler characterization system.

Exemplary embodiments are directed to calibrating a media curler for use in a printing system. In exemplary embodiments, a range of curls can be imposed on media to provide pre-curled media for characterizing the media curler and the imposed pre-curls can be measured to obtain curl values for the curls. A range of curl actuator settings can be used by the media curler to impose test curls on the pre-curled media affecting the pre-curls. Curls resulting from the interaction of the pre-curls and the test curls can be measured to obtain output curl values. The media curler can be characterized based on the curl values associated with the pre-curls, the output curl values, and the media curler settings. Exemplary embodiments can facilitate the imposition of a desired curl during normal operation of a printing system using a given media, under known conditions, by curling the media in response to a known input value and a desired output curl value.

As used herein, "media" refers to a tangible medium, such as paper (e.g, a sheet of paper, a long web of paper, a ream of paper, etc.), transparencies, parchment, film, fabric, plastic, or other substrates on which an image can be printed or disposed.

As used herein, a "curl" refers to a portion of media that deflects away from a reference surface and to "curl" refers to applying a curl to media by the curler.

As used herein, an "input curl" refers to a media that has a pre-curl which is used by a media curler to form an output curl and an "input value" or "pre-curl value" refers to a magnitude and direction of an input curl, such as a height of an input curl.

As used herein, an "output curl" refers to a curl in media after a media curler to be characterized curls media with a pre-curl and an "output curl value" or "output value" refers to a magnitude and direction of an output curl, such as a height of an output curl.

As used herein, a "media curler" refers to a device, apparatus, system, and the like that curls media.

As used herein, "characterizing" refers to determining or identifying the manner in which something responds to stimuli. For example, determining the manner in which a media curler responds to pre-curled media using given curler settings.

As used herein, a "media curler characterization system" refers to a system, for characterizing a media curler.

As used herein, a "curling unit" refers to a component of a media curler that curls media.

As used herein, an "actuator" refers to a component of a media curler that control an amount of curl applied to media by a curling unit.

As used herein, a "curler setting" refers to a parameter of a media curler used to configure the media curler to control an amount of curl applied to media. A curler setting can be, for example an actuator setting of an actuator in a media curler.

As used herein, "measurement module" refers to a system to detect, identify, measure, estimate, and the like, curls in media.

As used herein, "measuring" refers to determining and/or identifying an extent, dimensions, and the like, of something, ascertained by, for example, comparison with a standard unit of measurement, such as a meters and/or feet.

As used herein, "sensor" refers to a device that responds to a physical stimulus and transmits a resulting impulse or signal for the measurement and/or operation of controls. Such sensors include those that use pressure, light, motion, heat, sound, capacitance, magnetism, tactility, and the like. A sensor can include one or more point sensors and/or array sensors for detecting and/or measuring characteristics or parameters in a printing system, such as a distance from reference to a highest point of a curl in media, and the like.

As used herein, "desire" refers to wanting a particularly outcome or an outcome that approximates the particularly outcome.

As used herein, "known" refers to having been determined or having knowledge of.

As used herein, a "first pass" refers an initial passing of media through a media curler characterization system and a "second pass" refers to a second passing of the media through the media characterization system.

As used herein, a "return path" refers to a transport routing media from an output of a system to an input of a system to facilitate advancement of media from a first pass to a second pass.

As used herein, "process direction" refers to a direction in which substrate media is processed through a printing device and "cross-process direction" refers to a direction substantially perpendicular to the process direction.

As used herein, "downstream" refers to location of an object relative to a location of another object with respect to the process direction, wherein an object is downstream from another object when it is encountered by media after the other object in the process direction.

As used herein, "upstream" refers to location of an object relative to a location of another object with respect to the process direction, wherein an object is upstream from another object when it is encountered by media before the other object in the process direction.

As used herein, a "media transport" or "transport" refers to a component and/or assembly in a printing system, such as a belt, multiple parallel belts, a moving rigid platen, and the like, for transporting or carrying substrate media in the printing system.

As used herein, "rollers" refer to shafts, rods, cams, and the like, that rotate about a center axis. Rollers can facilitate rotation of a belt about the rollers and/or can form nips through which media passes.

As used herein, "transporting" or "transport" refers to carrying and/or moving an object or thing, such as media, from location to another location.

As used herein, a "processing device" refers to a processor or controller for executing commands or instructions for controlling one or more components of a system and/or performing one or more processes implemented by the system.

As used herein, a "computer storage device" refers to a device for storing computer files, instructions, and the like, and can include computer readable medium technologies, such as a floppy drive, hard drive, compact disc, tape drive, Flash drive, optical drive, read only memory (ROM), random access memory (RAM), and the like.

As used herein, "corresponding" refers to related, associated, and/or correlated things or objects, such as possible curl magnitudes and indentation settings.

FIG. 1 shows an exemplary media curler characterization system 100 (hereinafter "system 100") to characterize a media curler 110. The system 100 can determine which curler setting of the media curler to use to output a sheet of media with a desired output curl given the sheet has an curl at the input of the media curler having a know input curl value. The system 100 can include the media curler 110, a curl measurement module 140 (hereinafter "measurement module 140"), a processing device 150, and a computer storage device 160. In the present embodiment, the media curler 110 is positioned upstream of the measurement module 140. Sheets of media pass through the system 100 in a process direction 190 so that the media 102 initially passes through the media curler 110 and then the measurement module 140. Those skilled in the art will recognize that other embodiments can be implemented in which the measurement module 140 can be positioned upstream of the media curler 110.

The media curler 110 to be characterized can curl sheets of media by applying a down-curl or an up-curl to the sheets based on selected curler settings of the media curler 110. The curler settings used by the media curler 110 can determine an amount and/or a direction of curl that can be imposed on the sheets. The effect of the curler settings on the sheets can be unknown, especially when the media curler 110 receives sheets that already have a curl.

In the present embodiment, the media curler 110 can create an input curl by pre-curling a sheet of media in a first pass to be used for characterizing the media curler 110 in a second pass. In the second pass, the media curler 110 can curl the pre-curled sheet generated in the first pass to form an output curl, for example, by imposing a test curl. For example, the test curl can be imposed to affect the input curl such that the output curl is generated on the sheet based on the interaction between the input curl and the test curl. The output curl can have an output curl value to be determined by the measurement module 140.

In some embodiments, characterization of the media curler 110 can be performed using a series of sheets that are pre-curled in the first pass and that receive a test curl in the second pass. The curler settings of the media curler 110 used in the first pass and the curler settings of the media curler 110 in the second pass can be specified so that different combination pre-curls and test curls can be imposed on the sheets of media to provide a set of pre-curl or input values, output curl values, and curler settings that can be used to characterize the media curler 110. As one example, in a first pass, a first series of sheets can be pre-curled by the media curler 110 using fixed curler settings, and in a second pass, the sheets in the first series of sheets can be curled by the media curler 110 using a range of curler settings. In this example, each subsequent series of sheets can be pre-curled in the first pass using a different curler setting. As another example, a range of curler settings can be used by the media curler 110 for each series of sheets in the first pass and the curler settings of the media curler 110 can be fixed, but different for each series in the second pass. In this manner, the curler settings of the media curler 110 can be adjusted over a range of values so that different curl values can be achieved to facilitate comprehensive characterization of the media curler 110.

The measurement module 140 can determine a pre-curl value (i.e., an input value) associated with the pre-curl imposed in the pre-curled sheet of media in the first pass. For example, the measurement module 140 can determine a height and direction of the pre-curl in the pre-curled sheet. In this manner, the pre-curl value for the sheet of media can be determined, and therefore, known. A return path 195 can return the pre-curled sheet having the known pre-curl value from an output of the measurement module 140 back to the input of the media curler 110, where the media curler 110 processes the pre-curled sheet to impose a test curl on the pre-curled sheet.

The measurement module 140 can receive the sheet of media from the media curler 110 in the second pass. The measurement module 140 can determine output curl value associated with the output curls resulting from imposing a test curl on the pre-curled sheet by the media curler 110 to be characterized. For example, the measurement module 140 can determine a height and direction of the output curl in the sheet of media. The output curl value can be used, at least in part, to determine the effect of curler settings of the media curler 110 on pre-curled media.

The processing device 150 can be in communication with the media curler 110 and the measurement module 140 to implement a media curler characterization process 162 stored in the computer storage 160. As one example, in some embodiments, the processing device 150 can be configured to select curler settings of the media curler and to configure the media curler 110 based on the selected curler settings. As another example, the processing device 150 can be configured to receive, interpret, and process signals from the measurement module 140.

The storage device 160 can store instructions and information for executing the media curler characterization process 162. The instructions stored by the storage device 160 can be executed by the processing device 150 to cause the media curler characterization process to be implemented. The storage device 160 can also be configured to store the results of the media curler characterization process. For example, the storage device 160 can store characterization data 164 including associations between pre-curl values, output curl values, and curler settings used to impose test curls resulting in the output curl values, a function, transfer function, table, and the like, describing the effect of curler settings on different pre-curl values for the media curler 110, which can be generated using the stored pre-curl values, curler settings, and output curl values. The storage device 160 can be implemented using non-transitory computer readable medium, such as a floppy drive, hard drive, compact disc, tape drive, Flash drive, optical drive, read only memory (ROM), random access memory (RAM), and the like.

With reference to FIG. 1, in operation, a sheet 102 of media is curled by the media curler 110 in a first pass to impose a pre-curl on the sheet 102 according to a selected pre-curler setting. The sheet 102 is output from the media curler 110 to the measurement module 140, which determines a pre-curl value of the pre-curl. A curl value can be composed of a height and direction (e.g., positive or negative) relative to a reference surface and/or to a portion of the sheet. After the pre-curl value is determined for the pre-curled sheet 102, the measurement module 140 outputs the sheet 102 through the return path 195 back to the media curler 110 for the second pass.

In the second pass, the media curler 110 imposes a test curl to the media 102 based on a selected test curler setting of the media curler 110. The test curl affects the pre-curl value of the pre-curled sheet 102 by applying a down-curl or an up-curl to the portion of the sheet 102 where the known pre-curl is located. The sheet 102 is again output from the media curler 110 to the measurement module 140, which determines an output curl value for the output curl resulting from an interaction between the test curl and the known pre-curl. The pre-curl value, output curl value, and test curler setting are associated and stored, and additional sheets are processed by the system 100 to generate a set of associated pre-curl values, output curl values, and test curler settings. The media curler characterization process can be used to specify the appropriate media curler settings to curl media to achieve a desired output curl in media in response to a known pre-curl value associated with the media.

Figure 2:
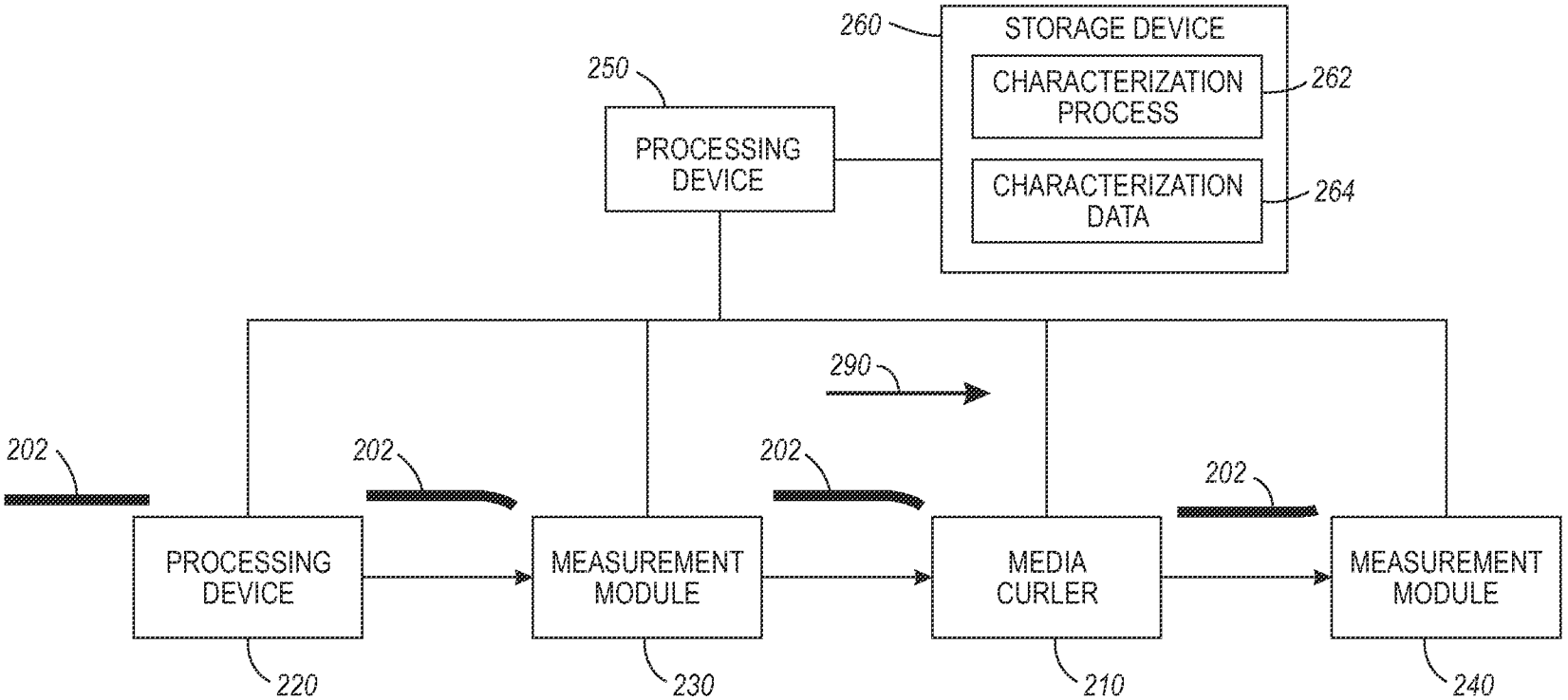
FIG. 2 shows another exemplary media curler characterization system.

FIG. 2 shows another exemplary media curler characterization system 200 (hereinafter "system 200") to characterize a media curler 210. The system 200 can determine which curler setting of the media curler to use to output a sheet of media with a desired output curl given the sheet has an curl at the input of the media curler having a know input curl value. The system 200 can include the media curler 210, a media curler 220, a curl measurement module 230 (hereinafter "measurement module 230"), a curl measurement module 240 (hereinafter "measurement module 240"), a processing device 250, and a computer storage device 260. In the present embodiment, the media curler 210 is upstream from the measurement module 240 and downstream from the media curler 220 and the measurement module 230. Sheets of media pass through the system 200 in a process direction 290 so that the sheets pass through the media curler 220, the measurement module 230, the media curler 210, and the measurement module 240, respectively.

The media curler 220 can pre-curl sheets of media to be used to characterize the media curler 210. The media curler 220 can pre-curl sheets of media by applying a down-curl or an up-curl to the sheets based on selected curler settings of the media curler 220. The curler settings used by the media curler 220 can determine an amount and/or a direction of curls imposed on the sheets of media. The curler settings of the media curler 220 can be adjusted over a range of values so that different pre-curl values can be achieved to facilitate comprehensive characterization of the media curler 210.

The measurement module 230 can determine pre-curl values associated with pre-curls imposed in the sheets of media. For example, the measurement module 230 can determine a height and direction (e.g., negative or positive) of the pre-curls relative to a reference surface and/or a portion of the sheets. In this manner, the pre-curl values for the sheets of media are determined, and therefore, known. The sheets of pre-curled media having the known pre-curl values can be output from the measure module 230 to the media curler 210, where the media curler 210 processes pre-curled sheets to impose test curls.

The media curler 210 to be characterized can curl sheets of media by applying a down-curl or an up-curl to the sheets of media based on selected curler settings of the media curler 210. The curler settings used by the media curler 210 can determine an amount and/or a direction curling to be imposed on the sheets of media. The media curler 210 can curl the sheets of pre-curled media generated by the media curler 220 to form output curls. For example, the media curler 210 can impose test curls that interact with the pre-curls of the sheets resulting in output curls being formed on the sheets of media. The output curls can have output curl values to be determined by the measurement module 240. The curler settings of the media curler 210 can be adjusted over a range of values so that different curl values can be achieved to facilitate comprehensive characterization of the media curler 210.

The measurement module 240 can receive sheets of media having output curls from the media curler 210 and can determine output curl values associated with the output curls resulting from imposing test curls on the pre-curled sheets.

For example, the measurement module 240 can determine a height and direction (e.g., negative or positive) of the output curls in sheets of media. The output curl values can be used, at least in part, to determine the effect the curler settings of the media curler 210 on pre-curled media.

The processing device 250 can be in communication with the media curlers 210 and 220 and the measurement modules 230 and 240 to implement a media curler characterization process 262 stored in the computer storage 260. As one example, in some embodiments, the processing device 250 can be configured to select curler settings of the media curlers and to configure the media curlers based on the selected curler settings. As another example, the processing device 250 can be configured to receive, interpret, and process signals from the measurement modules 230 and 240.

The storage device 260 can store instructions and information for executing the media curler characterization process 262. The instructions stored by the storage device 260 can be executed by the processing device 250 to cause the media curler characterization process to be implemented. The storage device 260 can also be configured to store the results of the media curler characterization process. For example, the storage device 260 can store characterization data 264 including associations between pre-curl values, output curl values, and curler settings used to impose test curls resulting in the output curl values, a function, transfer function, table, and the like, describing the effect of curler settings on different pre-curl values for the media curler 210, which can be generated using the stored pre-curl values, curler settings, and output curl values. The storage device 260 can be implemented using non-transitory computer readable medium, such as a floppy drive, hard drive, compact disc, tape drive, Flash drive, optical drive, read only memory (ROM), random access memory (RAM), and the like.

In operation, a sheet 202 of media is curled by the media curler 220 to impose a pre-curl in the sheet 202 and is output by the media curler 220 to the measurement module 230, which measures the pre-curl to determine a pre-curl value of the pre-curl. The curl value can be a height and direction of the pre-curl measured relative to a reference surface and/or to a portion of the sheet 202. After the pre-curl value is determined, the measurement module 230 outputs the sheet 202 having the pre-curl to the media curler 210, which imposes a test curl to the sheet 202 based on a curler setting of the media curler 210. The sheet 202 is output from the media curler 210 to the measurement module 240, which measures an output curl resulting from an interaction between the test curl and the known pre-curl to determine an output curl value of the output curl. The pre-curl value, output curl value, and test curler setting are associated and stored, and additional sheets are processed by the system 100 to generate a set of associated pre-curl values, output curl values, and test curler settings. The media curler characterization process can be used to specify the appropriate media curler settings to curl media to achieve a desired output curl in media in response to a known pre-curl value associated with the media.

Figure 3:
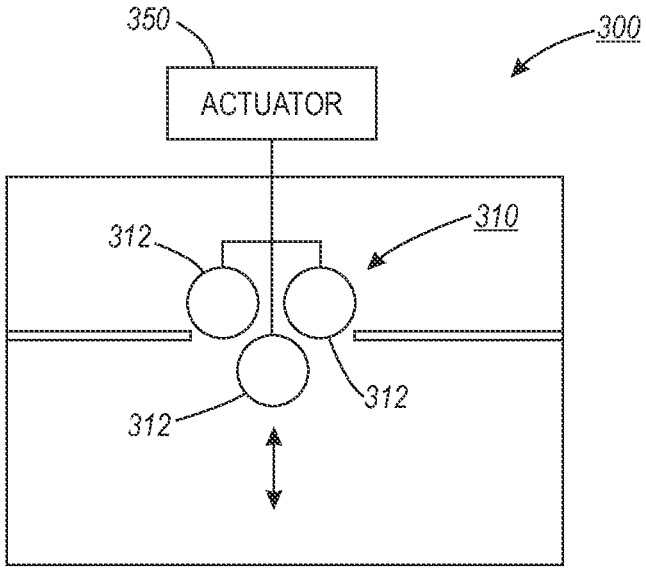
FIG. 3 shows an exemplary media curler that can be implemented in a media curler characterization system.

FIG. 3 is exemplary media curler 300 that can be implemented as one embodiment of the media curler 110, 210, and/or 220. The media curler 300 can include curling unit 310 and an actuator 350. In some embodiments, the curling unit 310 can be formed by a series of curling rollers 312 arranged so that the sheets of media to be curled pass between the rollers. One or more of the rollers can be adjustably positioned with respect to each other by the actuator 350 to adjust the amount of curl applied the sheets of media. The actuator 350 can control the curling unit 310 according to curler settings to adjust the amount of curl applied to the sheets of media. For example, in some embodiments, curler settings, such as actuator settings, can be specified to adjust a position of curling rollers of the curling unit 310 to control an amount and direction of curl to be applied to a sheet of substrate media.

Figure 4:
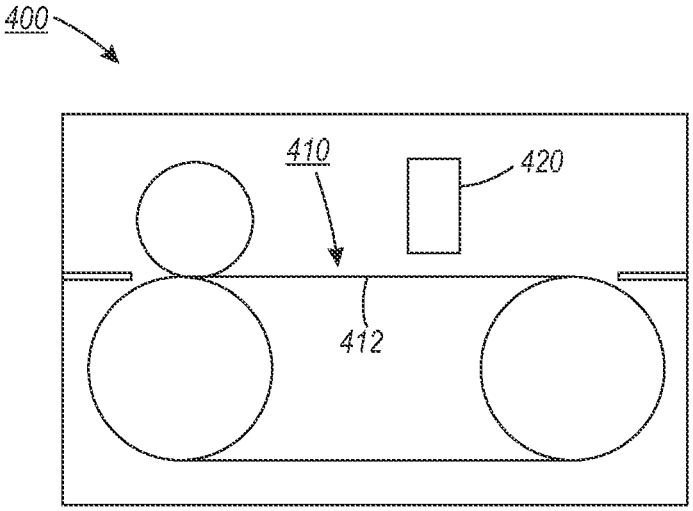
FIG. 4 shows an exemplary measurement module that can be implemented in a media curler characterization system.

FIG. 4 is an exemplary measurement module 400 that can be implemented as one embodiment of the measurement module 140, 230, and/or 240. The measurement module 400 can include a media transport 410 and a curl sensor 420. The media transport 410 can be implemented to transport media through the measurement module 400 and can include a reference surface 412. In some embodiments, the reference surface 412 can be formed by a driven transport belt supported about rollers and/or a platen. In some embodiments, the media transport can be configured to tack the media to the reference surface 412. For example, the media can be tacked to the reference surface by a hold down force using an electrostatic charge and/or a vacuum source.

The curl sensor 420 can detect the curls in sheets of media as the sheets are transported through the measurement module 400 to determine curl values. In some embodiments, the curl sensor 420 can be configured to detect a height of the curl in the media with respect to the reference surface 412. As one example, the curl sensor 420 can be configured as an array of infrared transmitter-receiver pairs forming a light current in a cross-process direction such that beams of infrared radiation propagate from the transmitter to the receiver in the cross process direction. The array of transmitter/receiver pairs positioned in an ascending order away from the reference surface 412 so that the height of the curl is determined by which of the transmitter-receiver pairs are interrupted by the curl and which of the transmitter-receiver pairs are not interrupted by the curl. As another example, the curl sensor 420 can be implemented as one or more proximity sensors, reflective sensors, acoustic sensors, a set of discrete mechanical flags, and the like.

Figure 5:
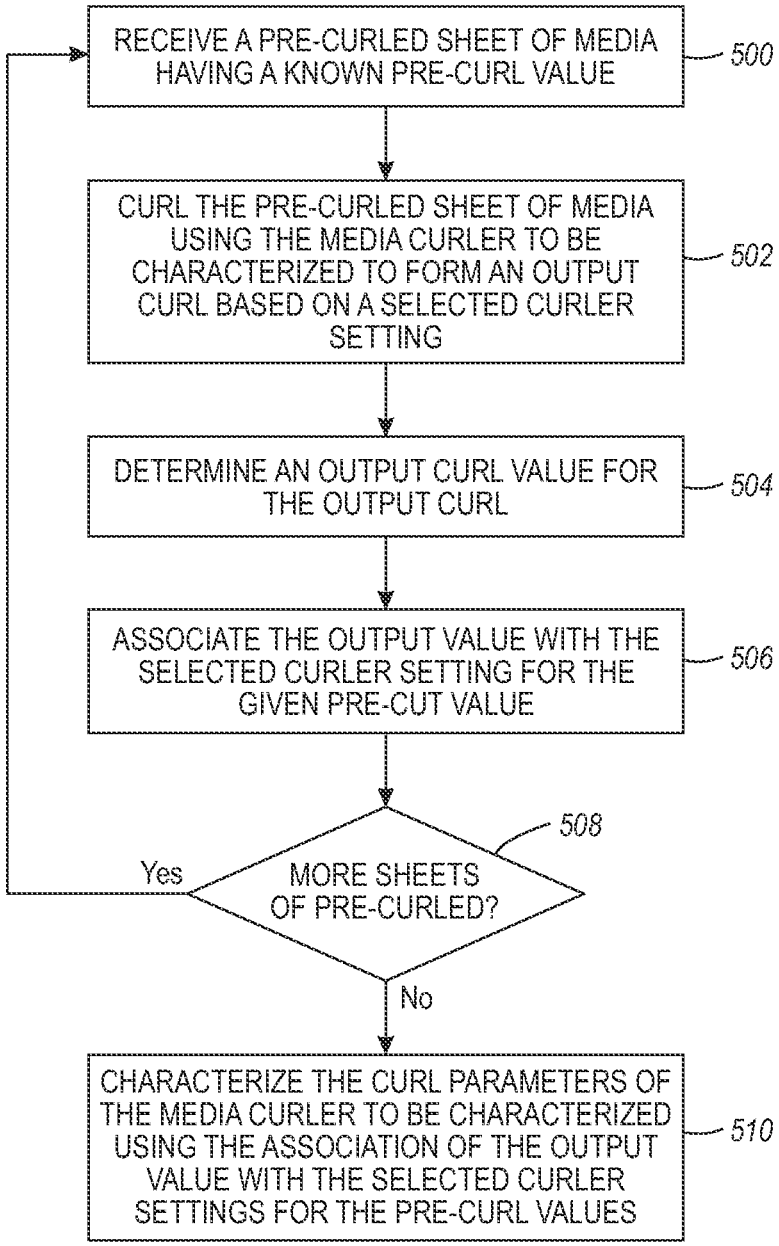
FIG. 5 is flowchart illustrating an exemplary process for characterizing a media curler.

FIG. 5 is an exemplary media curler characterization process that can be implemented by embodiments of a media curler characterization system. A sheet S(i) of media having a known pre-curl value C(i) enters a media curler to be characterized (500). In some embodiments, the sheet can be pre-curled by the media curler to be characterized or by a separate and distinct media curler, and the pre-curl value, such as a height and direction of the curl, can be determined by a measurement module to obtain the pre-curl value (i.e. input value). For example, the sheet S(i) of media can be pre-curled using a selected curler setting, such as an actuator setting of the media curler used to impose a pre-curl to the media. To determine the pre-curl value C(i) associated with the pre-curl, the sheet S(i) can be transported past a curl sensor in the measurement module.

The media curler to be characterized curls the pre-curled sheet of media to an output curl based on a selected test curler setting, such as an actuator setting A(i) (502). For example, the media curler to be characterized can impose a test curl to the pre-curled portion of the sheet of media resulting in the output curl having an output curl value K(i). The sheet S(i) of media can be output from the media curler to be characterized to the measurement module, which measures the output curl value K(i) of the output curl (504).

The input value, C(i), the curler setting, A(i), and the output curl value, K(i), corresponding the sheet, S(i), are associated and stored (506). It is determine whether more sheets will be processed (508). If so, the process repeats. Otherwise, the media curler is characterized using the sheets that have been processed (510). The process can be repeated for N sheets using different pre-curl values C(i) such that i=1, 2, 3, . . . , N and there can be corresponding a pre-curl value, curler setting, and output curl value for each sheet. Thus, N data points are collected that can be used to identify an output curl value K(i) as a function of input pre-curl value C(i) and the curler setting A(i) to determine how the media curler to be characterized will respond to various pre-curl values.

In some embodiments the output curl values K(i), pre-curl values C(i), curler settings A(i) can be associated and stored in a look-up table. The look-up table can be used by the media curler to determine which curler setting to use to achieve an output curl having a desired output value in response to a sheet having an input curl (i.e., pre-curl) with a known input value (i.e., pre-curl value). In some embodiments, using statistical analysis, regression or curve fitting a function K=f(C, A) can be generated based on the association between the collected pre-curl values, test curler settings, and output curl values. Hence, for each sheet j having a known input pre-curl value C(j), a desired output curl K can be obtained for the known input pre-curl value C(j) and a test curler setting A(j) used to generate the output curl K.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A media curler characterization system comprising:

a media curler to be characterized, the media curler being configured to curl a portion of media to form an input curl in a first pass according to a selected input curl setting and in a second pass through the media curler to impose a test curl on the portion of the media having the input curl based on a selected test curl setting to form an output curl, the output curl resulting from an interaction between the input curl and the test curl;

a measurement module configured to measure a value of the input curl and to measure a value of the output curl; and a processing device correlating the selected test curl setting with the measured output curl value and the measured input curl value, and calibrating the media curler responsive to the correlation, and wherein the processor controls the operation of the curler to produce a desired output curl based on the correlation of the selected curler setting with the measured output curl value.

2. The system of claim 1, wherein the media curler comprises a curling unit to apply curls to the media and an actuator to control the curling unit to adjust the curl applied by the curling unit.

3. The system of claim 1, wherein the measurement module comprises a sensor to detect a curl in the media and a media transport to move the media past the sensor.

4. The system of claim 1, wherein the processing device configures the media curler to select a curler setting to form a desired output curl based on known input values of input curls.

5. The system of claim 1, wherein a plurality of sheets of media are processed by the media curler and the measurement module to characterize a range of curler settings based on output values of the output curls for the plurality of sheets of media achieved by the curler settings for the input values of the input curls.

6. The system of claim 5, wherein the processing device correlates the input values, the output values, and the curler settings, the correlation being used to configure the media curler to respond to known input values by selecting a curler parameter to form a desired output value.

7. The system of claim 1, wherein the measurement module includes a first curl measurement device disposed upstream of the media curler for measuring an input value of the input curl and a second curl measurement device disposed downstream of the media curler for measuring an output value of the output curl.

8. The system of claim 1, wherein the processor generates a mathematical function based on the correlation between the input values, test curler settings, and output curl values to form the correlation.

9. A media curler characterization system comprising:

a first media curler to curl a portion of media to an input curl according to a selected input curl setting;

a first measurement module positioned downstream of the first media curler, the first measurement module measuring an input value of the input curl;

a second media curler positioned downstream of the first measurement module, the second media curler being under characterization and imposing a test curl on the portion of the media having the input curl based on a selected test curl setting to form an output curl, the output curl resulting from an interaction of the input curl and the test curl;

a second measurement module positioned downstream of the second media curler, the second media curler measuring an output value of the output curl; and a processing device forming a correlation between the test curler setting, the output value and the input value, and the processing device calibrates the media curler based on the correlation to select a curler setting to form an output curl having a desired output value in response to a known input value.

10. The system of claim 9, wherein a plurality of sheets of media are processed by the first media curler, the first measurement module, the second media curler, and the second measurement module to characterize a range of curler settings based on input values correlated with pre-curls in the plurality of sheets of media, curler settings used to generate output curls in the plurality of sheets, and output values achieved by the curler settings for the input values.

11. The system of claim 9, wherein the processing device correlates the input values, the output values, and the curler settings and configures the media curler to respond to known input values by selecting a curler parameter to form a desired output value.

12. The system of claim 9, further comprising computer storage to store the correlation between the curler setting, input value, and the output value for one or more media types and conditions.

13. A method of calibrating a media curler for a printing system comprising:

applying an input curl of known value on a portion of media according to a selected input curl setting;

applying a test curl to the media portion having the input curl to form an output curl using a media curler to be calibrated, the media curler applying the test curl based on curler setting of the media curler, the output curl resulting from an interaction between the input curl and the test curl;

measuring the input curl;

measuring an output value of the output curl;

correlating the resulting output value with the curler setting and input value with a processor; and configuring the settings of the media curler responsive to the correlation to calibrate the media curler.

14. The method of claim 13, further comprising applying the input curls on the media by a first media curler.

15. The method of claim 14, wherein applying the input curls is performed by a second media curler.

16. The method of claim 13, wherein the input curl value, output curl value, and curler settings are stored in memory, and additional sheets of media are processed to generate a set of correlated input curl values, output curl values, and curler settings.

17. The method of claim 13, further comprising configuring the media curler to respond to input media by selecting a curler setting based on an input value correlated with the input media and a desired output curl.

18. The method of claim 13, wherein the correlation includes the processor defining a mathematical function for determining an output curl value as a function of the input curl and curler setting.

19. The method of claim 13, further comprising passing the media through the curler a first time to obtain the input curls, and passing the media through the curler a second time to obtain the output curl.

* * * * *